United States Patent [19]

Lovell et al.

[11] 4,006,700

[45] Feb. 8, 1977

[54] METHOD FOR MAKING CONTAINER CLOSURES

[75] Inventors: Walter Carl Lovell, Wilbraham; Frederick Gerard Joseph Grise, Osterville, both of Mass.

[73] Assignee: USM Corporation, Boston, Mass.

[22] Filed: May 5, 1975

[21] Appl. No.: 574,643

[52] U.S. Cl. ..... 113/121 C; 113/15 A

[51] Int. Cl.[2] ..... B21D 51/40

[58] Field of Search ..... 72/121 C, 15 A, 15 R, 72/1 F

[56] References Cited

UNITED STATES PATENTS

| | | | |
|---|---|---|---|
| 3,583,348 | 6/1971 | Brown | 113/15 A |
| 3,760,752 | 9/1973 | Geiger | 113/121 C |
| 3,870,001 | 3/1975 | Brown | 113/121 C |
| 3,871,314 | 3/1975 | Stargell | 113/121 C |
| 3,888,199 | 6/1975 | Herrmann | 113/121 C |
| 3,918,378 | 11/1975 | Clawson | 113/121 C |
| 3,938,455 | 2/1976 | Urmston | 113/121 C |
| 3,946,683 | 3/1976 | Jordan | 113/121 C |

FOREIGN PATENTS OR APPLICATIONS

| | | | |
|---|---|---|---|
| 22,359 | 4/1905 | Sweden | 113/15 A |

*Primary Examiner*—C.W. Lanham
*Assistant Examiner*—Gene P. Crosby
*Attorney, Agent, or Firm*—Carl E. Johnson; Richard B. Megley; Vincent A. White

[57] ABSTRACT

The present method of creating a tear line in metal, of particular advantage when such a weakening line is to be uniformly reproduced in tougher sheet metal, involves combining the initial steps of (a) bending the largely unrestrained sheet material to form the closure periphery with tension inherent therein, and (b) concurrently coining longitudinally that portion of the periphery which is in tension thus to induce exactly to the required degree the fracture at the desired weakening line. Final steps of swaging and coating with sealant may then follow as hitherto taught to provide lids with easy-open closures capable of retaining fluid pressure.

6 Claims, 4 Drawing Figures

METHOD FOR MAKING CONTAINER CLOSURES

BACKGROUND OF THE INVENTION

This invention relates to an improved method for making manually disruptable container closures.

More specifically the present invention pertains to providing an improvement in the method disclosed in our U.S. Pat. No. 3,881,437 whereby an integral but fractured section may be more reliably and predictably created in even the alloys of tougher metals, for instance in sheet steel as well as in sheet aluminum.

The referenced method of providing a weakening line in a sheet metal lid, which line is characterized by being a fractured but integral section, contemplates that after a sheet metal closure has, at least in part, been defined by depressing the lid to provide the bounding wall of its closure, a lengthwise indentation by shear-coining will then be made in that formed wall to effect the fractured section. It has since been discovered that when practicing that method on tougher metal alloys, for instance sheet steel instead of aluminum, it can often be difficult to precisely and sufficiently control the tougher sheet material to attain the exact degree of fracture desired or required by means of the subsequent coining operation. Presumably this is largely due to the fact that the metal of the closure wall in the locality to be fractured is, when the prior practice is pursued, under compression and therefore resisting penetration by the coining tool. In softer sheet material this may not be disadvantageous, but in work on sheet steel material, for instance, from which easy-open can tops or the like are to be made, in addition to the more obvious blunting effect upon the coining die, a less consistently uniform degree of fracturing may result with consequently unsatisfactory, because less predictable, strength being imparted to the juncture of the lid with its closure.

SUMMARY OF THE INVENTION

In view of the foregoing, it is an object of this invention to provide an improved method of making sheet metal container closures to be defined at least in part by a fractured but integral section.

Another and more general object of this invention is to provide a more reliable and effective method for consistently producing precision weakening lines in sheet metal, such as steel, whereby subsequent manual rupture thereof, even after swaging of the metal adjoining the lines, can be achieved with substantially uniform predetermined pressure.

To these ends, and as herein shown, our novel process involves bending the sheet metal of a container lid portion to peripherally form and at least partly define a closure having a wall with a ridge extending on one side of the lid, and concurrently coining the closure wall to indent one side of the wall in a longitudinal locality under tension due to the bending thus creating a rupturable fractured but integral section between the closure and the lid. In performing the metal forming and coining concurrently rather than in steps sequence, certain advantages of importance are gained. As the coining tool impinges against a locality of one side of the closure wall, the sheet metal of that wall is being bent and consequently subjected to tensional stress imparted by forming dies. As the bending curvature increases and coin indenting becomes deeper, unit tension becomes greater at the critical locality where a controlled fracture of the wall is desired. Under these conditions the critical degree of fracture can now be precisely and repeatedly produced. Toughness in the sheet metal is now not an adverse factor either as to augmenting compression of the metal in resisting coining to the required degree of penetration or as to creating the degree of fracture desired.

Additionally the invention enables benefits in the form of simpler organization of the tooling employed in practicing the novel method. The concurrent forming and coining to render the closure weakening line fractured but integral with its cover or lid facilitates a double swaging to be attained for properly sealing the locality of fracture as disclosed in our U.S. Pat. No. 3,881,630.

BRIEF DESCRIPTION OF THE DRAWINGS

The foregoing and other features of the invention will now be more particularly described in connection with an illustrative embodiment and with references to the accompanying drawings thereof, in which.

DESCRIPTION OF PREFERRED EMBODIMENT

Figure 1:
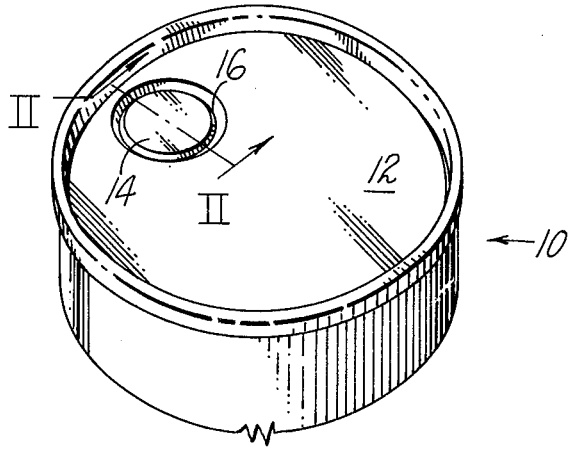
FIG. 1 is a perspective view of one product afforded by use of the invention, a can top produced by the present method and having a closure adapted to be manually openable.

While it will be appreciated that this invention is broadly useful in creating a tear line in sheet metal, the invention has particular utility in the formation of so-called "easy-open" metal containers 10, for instance in their can ends 12, an illustrative one of which is shown in FIG. 1. Neither the shape of the can end 12 or of the general configuration of a manually disruptable closure 14 to be formed therein by the present method need be limited to circular, such shapes being herein shown merely for convenience.

Figure 2:
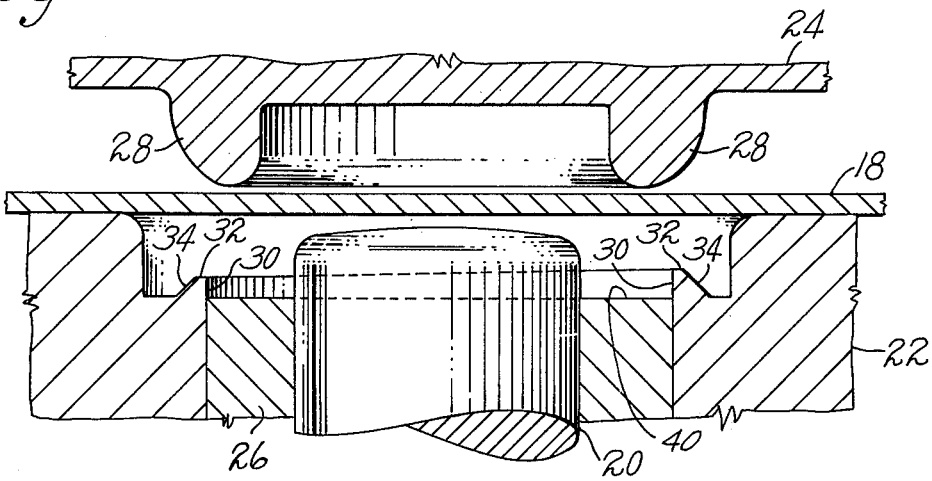
FIG. 2 is a vertical section of cooperative closure forming and coining dies taken when looking in the direction of the arrows II—II in FIG. 1 and prior to operation of the dies.

As taught in U.S. Pat. No. 3,881,437, the closure 14 is characterized by having at least a portion of its perephery defined by a specially fractured but integral section 16 (FIGS. 1, 4 sometimes more generally referred to as a tear or weakening line. The degree of fracture, especially when fluid pressures are to be reliably retained in the container 10, is clearly critical. Moreover, it is highly important to be able to uniformly and repeatedly create the fractured but integral section 16, even in tougher sheet metal, so that intentional opening of the completed closure can be gained manually with the exertion of only a normal, fairly predictable pressure. The novel technique for accomplishing such fractured weakening lines will next be explained with reference to sequential FIGS. 2–4.

A planar or nearly planar metal sheet 18 (FIG. 2) from which the container portion 12 is formed or to be formed is first suitably positioned and supported in substantially unrestrained manner between a lower forming die 20 coaxial with a coining tool 22, and an upper forming die 24. These dies are relatively movable together and apart along a vertical axis. In more usual practice and as here assumed, the coining tool 22 is stationary, but not necessarily so, and the upper die 24 is reciprocable. The coining tool 22 may be integral, but is herein shown non-integral, with a sleeve 26 slidably holding the lower forming die 20 which may ultimately serve as a knock out for ejecting the can end with its completed closure 14. Optionally when so desired, the sleeve 26 being independently and relatively movable heightwise with respect to the tool 22, swaging surface 40 of the sleeve can act on the sheet 18 prior to effecting its ejection.

Figure 3:
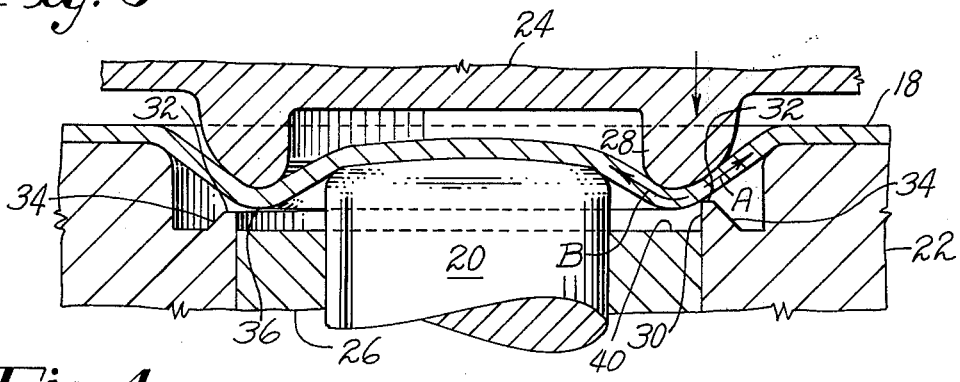
FIG. 3 is a section similar to FIG. 2 but at a moment later in the course of relative movement of approach of the dies concurrently to bend and coin.

The upper forming die 24 is formed with an annularly projecting rounded portion 28 which, as illustrated in FIG. 3, is arranged during a working stroke to engage the sheet 18 and bend it by imposing a trough therein in a recess defined by the upper end of the forming die 20, the sleeve 26, and the upper end of the coining tool 22. The tool 22 is formed with an internal vertically disposed annular cutting edge 30, an adjoining angularly related coining face 32, and an outer inclined face 34. The faces 32 and 34 are disposed to engage the convexly flexed under surface of the sheet 18, preferably outwardly of a ridge 36 being imposed by the portion 28. Thus the technique employed and being described is such that the sheet metal is being bent and formed thus to concomitantly subject it to stretching tension (as indicated by arrows A and B in FIG. 3) in a longitudinal locality and this same locality is concurrently being coined by the face 32.

Figure 4:
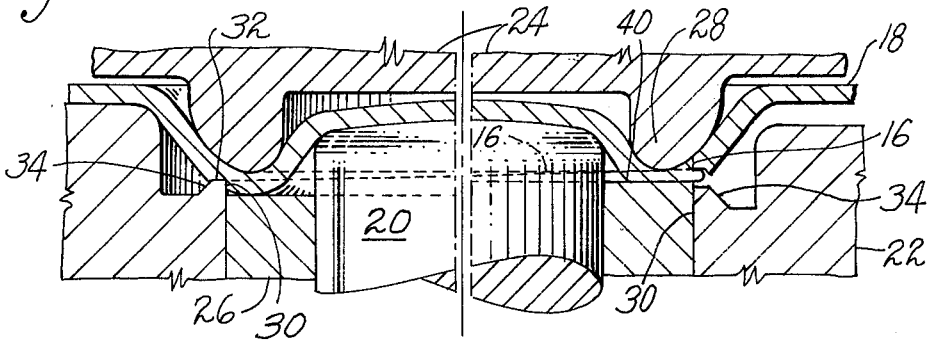
FIG. 4 is a section similar to FIG. 3 and showing the bottoming of the concurrent bending and coining to create a fractured but integral weakening line which thereafter may be urged as by swaging into "closed" or sealed condition.

As the relative movement of approach of the forming die 24 bottoms as shown in FIG. 4, penetration of the tensioned material 18 by the edges 30 and the face 32 has proceeded precisely to the required depth to produce the desired weakening line at the fractured but integral section 16. This synchronous coining and bending to produce tension in the locality being coined facilitates attainment of a precise, and when desired, a uniform degree of fracture, even in tougher metals such as steel, which is difficult to produce by the procedures hitherto known. It appears that by coin indenting sheet metal which is undergoing tensional stress rather than compression (except compression due to action of the coining tool), the metal does not "fight" the coining penetration to the same extent even though the metal is considered of a tougher character such as steel. Not only is service life of the coining tool increased as a consequence of improved metal flow, but more importantly as previously noted, the fractured but integral section 16 extending at the bottom of the penetration can reliably be given the exact residuum dimension required in the closure 14 or for any particular weakening line. In a typical sheet steel can end, for instance, the residuum or fractured section may be roughly about ⅓ the sheet thickness.

It will be understood that following the concurrent bending to form with tension and the coining to fracture, thereby at least partially defining the closure 14, subsequent closure making steps as hitherto taught, for instance as in the cited Pat. Nos. 3,881,437 and 3,881,630 herein incorporated by reference, may follow. Thus, a single or double swaging (not shown) may next be applied, single swaging by top surface 40 of the sleeve 26, for instance, to flow and enlarge wall metal adjacent to the fractured section 16 thereby tending to close and lock it to the can end 12. A coating of lacquer may lastly be applied to the weakening line 16 and/or the whole end 12. Combining the initial step of closure forming while fracturing, as one operation, enables the subsequent steps to produce closures 14 assuring reliable and consistently uniform operating character.

Having thus described our invention, what we claim as new and desire to secure by Letters Patent of the United States is:

1. The method of making a digitally disruptable line in sheet metal having opposite generally planar surfaces which method consists in substantially simultaneously bending a portion of the metal to form a wall with a locality bowed in tension adjacent to one surface thereof, and longitudinally coining said tensioned surface and locality of the wall as it is being thus bent to create in the residuum thickness adjacent to the opposite surface of said wall locality a fractured but integral section defining said line.

2. The method of making a digitally disruptable weakening line in otherwise substantially planar sheet metal comprising the steps of concurrently (a) arcuately bending a substantially unrestrained portion of the metal to provide a wall with a surface thereof having a bowed longitudinal locality stressed in tension and (b) coining said bowed longitudinal locality of said surface to a depth sufficient to create a fractured but integral section defining the line of weakening and thereafter swaging the metal adjacent to the line to lock the edges of the fracture into closed relation.

3. The method of making a digitally disruptable closure in a sheet metal container component, comprising synchronously combining bending of a substantially unrestrained portion of the metal thus to provide a transversely arcuate closure wall subjected along a surface thereof to transverse tension, with longitudinally coining that wall surface portion thus being tensioned, the depth of the coined indentation creating a residuum fractured but integral section, and thereafter swaging the metal along one side of the indentation to cause the metal to close and thereby reinforce said fractured section.

4. The method of claim 3 wherein the synchronous bending and coining is effected by relative reciprocable movement of approach along an axis of non-contacting dies one of which has a projecting convex forming surface for working on said wall on one side of the sheet metal, and another of which dies has a blunt or flatted coining face and a cutting edge for partly penetrating the opposite side of the metal wall being formed and being tensioned by said one die in cooperation with said other die, the configuration of said coining face being adapted to limit the penetration to effect a residuum fracture on the order of about one-third the thickness of said sheet component.

5. The method of claim 4 wherein said convex forming surface of the one die bends the wall metal into a continuous transversely arcuate recess defined at least in part by said other die, and the coining face of said other die is arranged to longitudinally indent said opposite sheet metal side during its bending to provide said fractured section along a line adjacent to the ridge of said convex forming surface.

6. The method of producing a fractured but integral weakening line in sheet steel of a thinness to serve as a container end having a digitally rupturable closure defined by the line comprising (a) concurrently bending a portion of the steel over a backing and forming tool the work engageable surface of which has an uninterrupted convex profile and longitudinally extends to define the general configuration of said line, and longitudinally coining the steel portion, as it is thus bent, from its side opposite to the side backed and engaged by the tool, said opposite side being thereby incised while under tension and to a depth inducing fracture extending toward said tool-engaged side, (b) while the backing and forming tool is still in work-engaging relation, withdrawing the coining tool from the incision, and (c) immediately thereafter swaging said side still in transverse tension against said uninterrupted convex profile at least once closely adjacent to the incision to cause the metal of a wall thereof to flow and tend to tighten and close said fracture.

* * * * *

UNITED STATES PATENT OFFICE

CERTIFICATE OF CORRECTION

Patent No. 4,006,700 Dated February 8, 1977

Inventor(s) Walter C. Lovell et al.

It is certified that error appears in the above-identified patent and that said Letters Patent are hereby corrected as shown below:

On the cover sheet, item [73] should be omitted.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*